United States Patent [19]

Pieters et al.

[11] Patent Number: 4,846,641

[45] Date of Patent: Jul. 11, 1989

[54] READILY-REMOVABLE FLOATING BUSHING PUMP CONSTRUCTION

[75] Inventors: Ferdinandus A. Pieters, Concord; Thomas B. Martin, Walnut Creek, both of Calif.

[73] Assignee: Micropump Corporation, Concord, Calif.

[21] Appl. No.: 756,665

[22] Filed: Jul. 19, 1985

Related U.S. Application Data

[63] Continuation of Ser. No. 521,049, Aug. 8, 1983, abandoned.

[51] Int. Cl.[4] ..... F04C 2/18; F04C 13/00

[52] U.S. Cl. ..... 418/70; 417/420; 418/206

[58] Field of Search ..... 418/206, 158, 131–135, 418/70–74, 205, 266; 417/420; 403/326; 411/517–519, 521, 353

[56] References Cited

U.S. PATENT DOCUMENTS

| | | | |
|---|---|---|---|
| 2,062,045 | 11/1936 | Van Deventer | 417/360 |
| 3,238,883 | 3/1966 | Martin | 417/420 |
| 4,414,523 | 11/1983 | Pieters | 417/420 |

*Primary Examiner*—Leonard E. Smith
*Attorney, Agent, or Firm*—Julian Caplan

[57] ABSTRACT

A rotary pump has a block with inlet and outlet ducts and ports. A pump housing forming a pump cavity and accommodating working means of the pump, e.g., gears, is located on one side of the pump block, whereas drive means such as a magnetic coupling are placed on the other side of the block. In the case of a gear pump, the driving gear is connected to the drive magnet of the coupling through a drive shaft which passes through the axial bore in the block. The drive gear meshes with a driven gear which is mounted on a second shaft, also supported in bushings in the block. One set of ends of the shafts extends outside the pump housing and are inserted into bushings loosely fitted in recesses of a bearing support plate. This plate is attached to the block by removable screws extending through holes in the supporting plate and pump housing. The arrangement described makes it possible to replace worn parts of the pump, such as gears, shafts and bushings in a matter of minutes without the necessity of disconnecting the pump block and any piping or electrical connections to the motor.

8 Claims, 1 Drawing Sheet

READILY-REMOVABLE FLOATING BUSHING PUMP CONSTRUCTION

This is a continuation, of application Ser. No. 06/521,049 filed 8/8/83, now abandoned.

FIELD OF INVENTION

The present invention relates to rotary pumps and more particularly to new and improved pump, wherein a bearing support may be removed without disturbing the motor mounting or pipe connections to provide ready access to replace gears (or other pump means), shafts and bushings. The preferred embodiment illustrated and described is a magnetically driven rotary gear pump.

BACKGROUND OF INVENTION

Any magnetically coupled gear or contrifugal pump must have its own shaft bearings within itself as it cannot rely upon the support of the motor shaft or any other conventional external bearing support. However, when pumping any non-lubricating fluid, shaft, impeller, gear and bearing wear is always a problem to some degree or another. Therefore, the ease with which these elements of the pump can be replaced, when necessary, is important for economic maintenance.

DESCRIPTION OF PRIOR ART

Conventional magnetically coupled rotary pumps have a block and a cup-like member of a non-magnetic material with a rim engaging the the block to define a pump cavity. The block is provided with inlet and outlet ducts which are connected to the pump cavity. Inside the non-magnetic cup there is a driven magnet, which is secured to the shaft of a working element of the pump (an impeller, in the case of a centrifugal pump, and one of the gears, in the case of a gear pump). Bushings, which support the gear or impeller shaft journals, are typically pressed into the pump block and into other bearing support plate inherent in the design of any particular pump.

In order to replace any of these elements, the pump must be completely disassembled, the bushings are pressed out and new bushings pressed in, the driven magnet installed on the shaft of a new gear or impeller and the pump reassembled.

Thus, when it is necessary to replace the worn parts, the pump must be completely disconnected from service. Moreover, the replacement is an inconvenient and time-consuming operation.

OBJECTS

It is a main object of the present invention to provide a rotary pump which has a new and improved design and does not require disconnection of its block, piping and electrical wiring for removal of worn parts.

Another object of this invention is to improve and expedite repairability of magnetically coupled rotary pumps.

Still another object is to simplify the assembling and disassembling of magnetically coupled rotary pumps, particularly for repair. A further object of the invention is to provide access to the worn parts for their replacement from outside of the pump.

Other objects of the present invention will become apparent upon reading the following specification and referring to the accompanying drawings in which similar characters of reference represent corresponding parts in each of the several views.

IN THE DRAWINGS

DETAILED DESCRIPTION OF THE PREFERRED EMBODIMENT OF INVENTION

The invention is illustrated by way of a preferred embodiment thereof in the form of a magnetically coupled gear pump.

Figure 4:
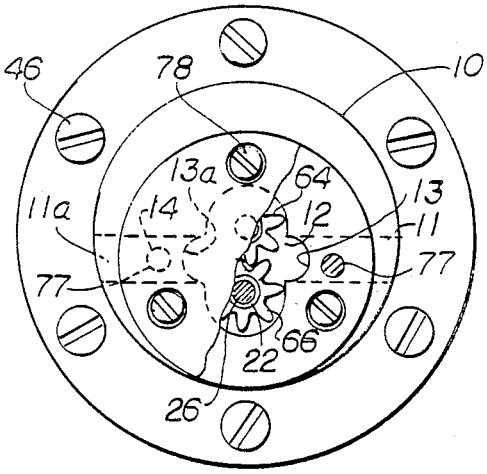
FIG. 4 is end view of the structure of FIG. 1 viewed from the left.

Referring to the drawings, a gear pump comprises a pump block 10 with inlet and outlet ducts 11, 11*a* which are connected to a pump cavity 12 (FIG. 4) via corresponding inlet and output ports 13, 13*a*.

Figure 1:
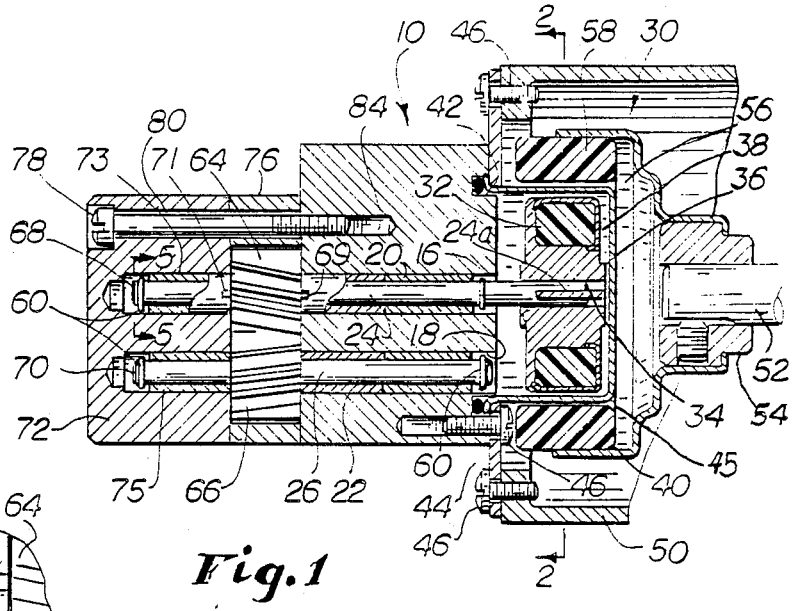
FIG. 1 is a longitudinal sectional view of a gear pump made according to the present invention.
Figure 2:
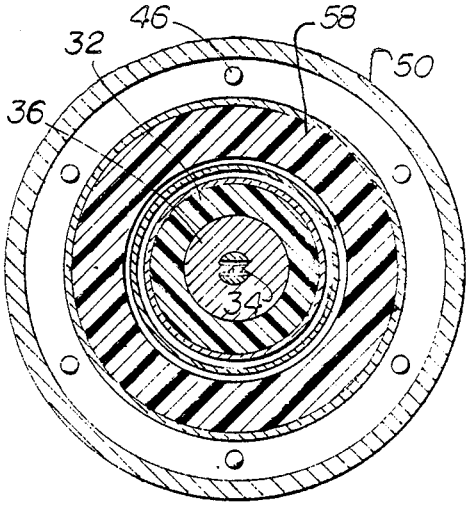
FIG. 2 is a cross-sectional view along line 2—2 in FIG. 1 illustrating the attachment of the driven magnet to the gear shaft.

There are two through bores 16 and 18 formed in axial direction of the pump block which accommodate bushings 20 and 22, respectively, loosely fitted in these bores. The length of the bushings 20 and 22 is less than the width of the pump block 10 and their diameters are less than bores 16 and 18. Hence, the bushings 20, 22 tend not to rotate with the shafts 24, 26 which they support, but to remain substantially stationary or "float". The bushings 20,22 are made of a wear resistant antifriction material. Bushings 20 and 22 rotatably support drive shaft 24 and idler shaft 26. Shaft 24 extends outside the pump block 10 and is fixed for rotation with driven magnet 32 of a magnet coupling 30. In the illustrated embodiment, this connection is made through a slot 24*a* in the end of shaft 24 into which fits a septum 34 (FIGS. 1 and 2) in a molded magnet hub 36 (FIG. 1). Septum 34 serves to transfer the torque from the motor (not shown) to the shaft 24 through the magnetic coupling 30.

The driven magnet 32 comprises a molded assembly and is located concentrically in a cavity 38 defined by a cup 40 made of a thin non-magnetic material. Rim 42 on the edge of cup 45 is inserted into an annular recess on the end face of the pump block 10 and fixed thereto by a cover 44 clamped to the pump block 10 by screws 46. An elastomeric seal ring seals rim 42 to block 10 to prevent leakage. The same cover 44 forms a flange which is used for attachment of the pump block 10 to a stationary support or the like.

Shaft 52 of a drive motor (not shown in the drawings) is connected through a hub 54 and a thin cup-shaped holder 56 of a non-magnetic material to a drive magnet 58. Both magnets 32 and 58, which have a gap therebetween, remain in axial alignment due to the centering force of their respective poles.

The shafts 24 and 26 are provided at each end outside of the bushings 20 and 22 with retaining rings 60 which keep the bushings in place.

A chamfer 62 is made at the end of the shaft 24 to facilitate its insertion into the hole in the magnet hub 36.

Figure 5:
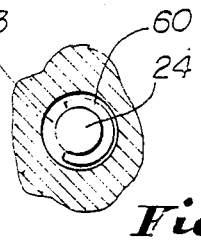
FIG. 5 is a cross-sectional view along line 5—5 of FIG. 3.
Figure 3:
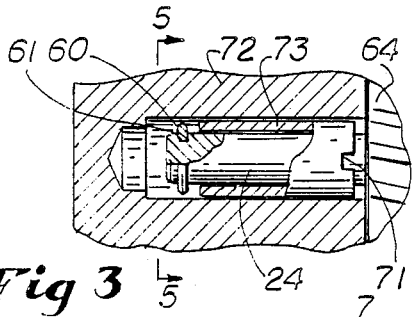
FIG. 3 is an enlarged, fragmentary sectional view of a portion of FIG. 1.

In FIGS. 1, 3 and 5, the retaining rings 60 are shown in the form of C-shaped snap rings which are located in grooves 61 formed on corresponding ends of the shafts 24 and 26.

Figure 7:
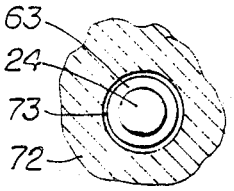
FIG. 7 is a cross-sectional view along lines 7—7 in FIG. 6.
Figure 6:
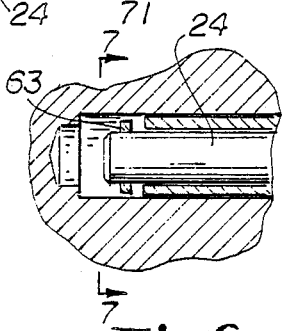
FIG. 6 is the same view as shown in FIG. 3, but illustrating a modification of retainer rings.

However, the retaining rings 60 may be made in the form of pressed-on deformable rings 63 (FIGS. 6 & 7) of a ductile material stretched beyond its elastic limit to fit on the respective shafts. Tension in rings 63 is reliably uniform and provides the necessary friction to hold rings 63 in place. Use of rings 63 simplifies construction since it does not require formation of grooves 61 in the shafts.

The opposite ends of the shafts 24 and 26 pass through and are fixed to respective gears 64 and 66 and extend into bores 68 and 70 in bearing support plate 72. Bushings 73 and 75 are loose on the left ends of shafts 24, 26 and are loose in the bores 68 and 70.

In order to ensure circulation of the liquid in the bores 16 and 68 through gaps between the outer surfaces of bushings 20 and 73 and inner surfaces of respective bores 16 and 68, radial slots 69 and 71 are formed at the ends of bushings 20, 22, 73 and 75 facing the gears 64 and 66.

The drive gear 64 is keyed or otherwise fixed to shaft 24 and driven gear 66 is fixed to its shaft 26. The gears 64 and 66 are accommodated within a pump cavity 74 defined in the interior of a cylindrical pump housing 76 which is located by pins 77 fitting into recesses in the face of block 10. The pump cavity is sealed by clamping the bearing support plate 72 to the pump block 10 by means of removable screws 78 which pass through support holes 80 formed in the bearing support plate and holes 82 in the pump housing and are screwed into threaded holes 84 in the pump block 10.

The width of gears 64, 66 is very slightly smaller than the width of the pump housing 76 in order to ensure their free rotation inside the pump cavity 74.

For replacing worn parts such as shafts, gears and bushings, the screws 78 are removed, the bearing support plate 72 is easily taken off from the shaft ends, as the bushings 73 and 75 are loosely fitted in their respective recesses 68 and 70 of the bearing support plate 72. The pump block 10 remains in place. Now the pump housing 76 may be removed and the gears 64 and 66 are withdrawn along with their respective shafts and bushings. New gears with their bushings can be inserted engaging the slotted shaft end 24*a* with the septum 34 of driven magnet 32. The pump housing 76 and bearing support plate 72 are replaced and secured with the three screws 78 in a matter of minutes without disconnecting any piping to ducts 11, 11*a* or any electrical connection to the motor.

What is claimed is:

1. A rotary pump comprising a driven magnet having first connection means, a pump block having an axial first bore aligned with said first connection means, support means fixed to said pump block, a pump housing formed with a pump cavity adjoining said pump block, said pump block having a fluid inlet and a fluid outlet communicating with said pump cavity, a support plate adjoining said pump housing on the side opposite said pump block and formed with a second bore aligned with said first bore, detachable retainer means holding said pump block, pump housing and support plate assembled, a shaft having second connection means cooperable with said first connection means whereby said driven magnet turns said shaft, said magnet being axially movable relative to said shaft, pump means fixed to said shaft in said cavity and operable to pump fluid from said inlet to said outlet, a first bushing loose axially and radially on said shaft and loose radially and axially in said first bore, and a second bushing loose axially and radially on said shaft and loose radially and axially in said second bore, said cavity being substantially the same dimension throughout from the side of pump housing adjacent said pump block to the side of said pump housing adjacent said support plate and said cavity being large enough so that, when said support plate is removed from said pump housing upon detachment of said retainer means, said pump means, said shaft and said first and second bushings may be removed from said pump for repair or replacement, without further disassembly of said pump, said first and second connection means being thereby disconnected, and said pump block remaining fixed to said support means.

2. A pump according to claim 1 in which said pump means comprises a first gear and which further comprises a second gear, a second shaft fixed to said second gear, a third bore in said pump block, a fourth bore in said support plate, and third and fourth bushings loose radially and axially on said second shaft and loose radially and axially in said third and fourth bores, respectively, said cavity being large enough so that upon detaching said retainer means said second shaft, said second gear and said third and fourth bushings may be removed from said pump for repair or replacement.

3. A pump according to claim 1 in which said pump means comprise meshing gears.

4. A pump according to claim 1 which further comprises second retainer means on said shaft for axially retaining said first and second bushings.

5. A rotary pump according to claim 4 in which at least one end of at least one said bushing is formed with a radial slot.

6. A rotary pump according to claim 4, wherein said second retaining means comprises retainer rings fixed to said shaft.

7. A rotary pump according to claim 6 in which shaft formed with a groove and said second retaining means comprises a snap ring fitting in said groove.

8. A rotary pump according to claim 6 in which said second retaining means comprises a deformable ring forced beyond its elastic limit onto said shaft.

* * * * *